United States Patent [19]

Faul et al.

[11] 3,998,637

[45] Dec. 21, 1976

[54] PROCESS FOR PRODUCING POSITIVE COLOR DIFFUSION TRANSFER IMAGES USING REDOX DYE RELEASERS

[75] Inventors: William Henry Faul; Harry David Franchino, both of Rochester, N.Y.

[73] Assignee: Eastman Kodak Company, Rochester, N.Y.

[22] Filed: Aug. 1, 1975

[21] Appl. No.: 601,067

Related U.S. Application Data

[63] Continuation-in-part of Ser. No. 487,086, July 10, 1974, abandoned.

[52] U.S. Cl. ..... 96/3; 96/21; 96/22; 96/29 D; 96/51; 96/54; 96/55

[51] Int. Cl.[2] ..... G03C 7/00; G03C 5/54; G03C 7/16

[58] Field of Search ..... 96/3, 29 D, 51, 54, 96/55, 21, 22

[56] References Cited

UNITED STATES PATENTS

| | | | |
|---|---|---|---|
| 3,227,550 | 1/1966 | Whitmore et al. | 96/3 |
| 3,443,940 | 5/1969 | Bloom et al. | 96/3 |
| 3,443,943 | 5/1969 | Rogers et al. | 96/3 |
| 3,628,952 | 12/1971 | Poschel et al. | 96/3 |
| 3,698,897 | 10/1972 | Gompf et al. | 96/3 |
| 3,725,062 | 4/1973 | Anderson et al. | 96/3 |
| 3,734,726 | 5/1973 | Figueros et al. | 96/3 |

OTHER PUBLICATIONS

B351,673 Jan. 1975, Fleckensteine et al. 96/3.

*Primary Examiner*—David Klein
*Assistant Examiner*—Richard L. Schilling
*Attorney, Agent, or Firm*—C. O. Thomas

[57] ABSTRACT

Positive color diffusion transfer images are produced by a process that employs light-sensitive photographic elements containing dye-releasing redox agents. The dye-releasing redox agents may be a sulfonamido compound or a hydroquinone derivative which are capable of cleaving to release a diffusible color-providing moiety. A preferred process involves the use of black-and-white developer compositions and comprises 1. developing only a negative silver image in the imagewise exposed areas of the photographic element;
2. fogging the residual silver halide;
3. developing the residual silver halide in the fogged element to silver and concurrently releasing a diffusible dye or dye precurser in the non-image, fogged silver halide areas; and
4. at least a portion of the diffusible dye or dye precurser compound diffusing to a dye image-receiving layer.

8 Claims, No Drawings

PROCESS FOR PRODUCING POSITIVE COLOR DIFFUSION TRANSFER IMAGES USING REDOX DYE RELEASERS

This is a continuation-in-part of our co-pending application Ser. No. 487,086, filed July 10, 1974, now abandoned.

FIELD OF THE INVENTION

This invention relates to photography and more particularly to color, diffusion transfer photography and to processes for producing reversal color images in a diffusion transfer photographic system comprising a dye-releasing redox agent and a negative-working silver halide emulsion.

BACKGROUND OF THE INVENTION

Color, diffusion transfer processes of the prior art such as U.S. Pat. No. 2,983,606 generally involve the use of a photographic element comprising a support, at least one silver halide emulsion layer, and contained therein or contiguous thereto a dye developer. A liquid processing composition is applied to the photosensitive element and permeates the emulsion to provide a solution of the dye developer substantially uniformly distributed therein. As the exposed silver halide emulsion is developed, the oxidation product of the dye developer is immobilized or precipitated in situ with the developed silver, thereby providing an imagewise distribution of unoxidized dye developer dissolved in the liquid processing composition. This immobilization is apparently due, at least in part, to a change in the solubility characteristics of the dye developer upon oxidation, and particularly as regards its solubility in alkaline solutions. At least part of this imagewise distribution of unoxidized dye-developer is transferred to a superposed image-receiving layer to provide the transfer image.

The prior art has typically employed positive-working emulsions such as internal image silver halide emulsions and solarizing direct positive silver halide emulsions to produce direct positive color images in a diffusion transfer system. For example, Belgian Pat. No. 788,268 and U.S. Pat. No. 3,725,062 relate to such positive-working emulsions. The use of positive-working emulsions, however, does not offer the high exposure speed obtained with negative emulsions. Typically, positive-working emulsions are relatively difficult to produce.

OBJECTS OF THE INVENTION

It is therefore an object of the present invention to provide a novel process for producing direct positive color images in a diffusion transfer photographic system comprising a negative-working silver halide emulsion and using black-and-white developing agents.

It is a further object of the present invention to provide such a novel process for producing direct positive color images in diffusion transfer systems comprising a dye-releasing redox agent.

These and other objects are achieved by our invention which is described hereinafter.

SUMMARY OF THE INVENTION

A process for producing a positive photographic transfer image in color according to our invention comprises:

1. forming a negative silver image in an imagewise exposed photosensitive photographic element, said photographic element comprising a support having thereon at least one light-sensitive negative-working silver halide emulsion layer and associated therewith a sulfonamido or hydroquinone type dye-releasing redox agent;
2. fogging the residual silver halide in the element;
3. developing the residual silver halide in the fogged element to silver and concurrently releasing a diffusible dye or dye precurser in the non-image, fogged silver halide areas; and
4. permitting at least a portion of the diffusible dye or dye precurser to diffuse to a dye image-receiving layer to thereby provide an image.

Multi-color images may be produced using the process described above. Photographic elements useful in producing such multi-color images usually contain three light-sensitive color-forming units, one unit sensitive to each of the primary colors of light - red, green and blue. Each color-forming unit comprises at least one silver halide emulsion layer, appropriately sensitized to a primary color of light, and has associated therewith a dye-releasing redox agent which releases a dye-providing moiety which provides a dye complementary in color to the primary color to which the silver halide emulsion is sensitized.

A suitable method for applying the processing compositions of our invention is by employing a split pod construction well known in the art of diffusion transfer photography. The pod can contain one composition for accomplishing the first developing step and a second composition to accomplish chemical fogging and the second developing step to thereby both fog and develop the residual silver halide while concurrently releasing a color providing substance in the fogged areas for diffusion to a receiving layer.

DETAILED DESCRIPTION OF THE INVENTION

Photographic elements employed in the practice of this invention can contain any of the known redox compounds which are capable of releasing a color providing moiety upon cross-oxidation with an oxidized developing agent. Suitable color providing substances include the ballasted, dye-releasing sulfonamidophenols and sulfonamidoanilines described in Belgian Pat. No. 788,268 issued Feb. 28, 1973 and the ballasted hydroquinone derivatives described in U.S. Pat. No. 3,725,062 issued Apr. 3, 1973.

Such useful redox compounds include those sulfonamido compounds which may be represented by the following general formula:

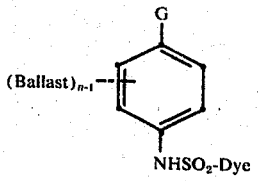

(I)

wherein:

1. Dye is a dye or dye precursor moiety;
2. Ballast is an organic ballasting radical of such molecular size and configuration (e.g. simple organic groups or polymeric groups) as to render the compound nondiffusible during development in an alkaline processing composition;

3. G is OR or $NHR_1$ wherein R is hydrogen or a hydrolyzable moiety and $R_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc., (when $R_1$ is an alkyl group of greater than 6 carbon atoms, it can serve as a partial or sole Ballast group); and
4. *n* is a positive integer of 1 to 2 and is 2 when G is OR or when $R_1$ is hydrogen or an alkyl group of less than 8 carbon atoms.

In addition to Ballast, the benzene nucleus in the above formula may have groups or atoms attached thereto such as the halogens, alkyl, aryl, alkoxy, aryloxy, nitro, amino, alkylamino, arylamino, amido, cyano, alkylmercapto, keto, carboalkoxy, heterocyclic groups, etc. In addition, such groups may combine together with the carbon atoms to which they are attached on the ring to form another ring which may be saturated or unsaturated including a carbocyclic ring, a heterocyclic ring, etc. Preferably an aromatic ring is directly fused to the benzene nucleus which would form, for example, a naphthol. Such a p-sulfonamidonaphthol is considered to be a species of a p-sulfonamidophenol and thus included within the definition. The same is true for p-sulfonamidoanilines of the invention.

Useful hydroquinone derivatives which may be used according to this invention can be represented by the following formula:

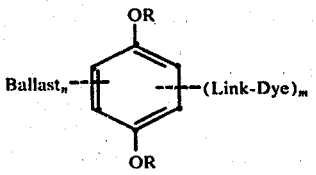

(II)

wherein:

1. each R represents hydrogen or a hydrolyzable moiety;
2. Ballast is a photographically inert organic ballasting radical of such molecular size and configuration as to render the alkali-cleavable compound nondiffusible during development in an alkaline processing composition;
3. Dye is a dye or dye precursor;
4. Link is a S, O, or $SO_2$ linking group;
5. *n* is an integer of 1 to 3; and
6. *m* is an integer of 1 to 3.

The nature of the ballast group (Ballast) in the formula for the compounds described above is not critical as long as it confers nondiffusibility to the compounds. Typical ballast groups include long-chain alkyl radicals linked directly or indirectly to the compound as well as aromatic radicals of the benzene and naphthalene series indirectly attached or fused directly to the benzene nucleus, etc. Useful ballast groups generally have at least 8 carbon atoms such as a substituted or unsubstituted alkyl group of 8 to 22 carbon atoms, an amide radical having 8 to 30 carbon atoms, a keto radical having 8 – 30 carbon atoms etc.

As previously mentioned, Dye in the above formulas represents a dye or dye precursor moiety. Such moieties are well-known to those skilled in the art and include dyes such as azo, azomethine, azopyrazolone, indoaniline, indophenol, anthraquinone, triarylmethane, alizarin, metal complexed dyes, etc., and dye precursors such as a leuco dye, a "shifted" dye which shifts hypsochromically or bathochromically when subjected to a different environment such as a change in pH, reaction with a material to form a complex, etc. Dye could also be a coupler moiety such as a phenol, naphthol, indazolone, open-chain benzoyl acetanilide, pivalylacetanilide, malonamide, malonanilide, cyanoacetyl, coumarone, pyrazolone, compounds described in U.S. Pat. No. 2,765,142, etc. These compounds may contain a solubilizing group if desired. Examples of such dye groups include the following:

YELLOW DYE GROUPS

YDG-1 4-Hydroxyazophenylphenylene

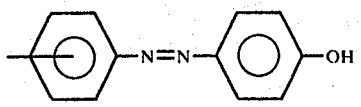

YDG-2 3-Methyl-4-hydroxyazophenylphenylene

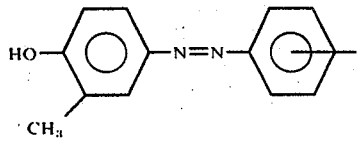

YDG-3

-continued
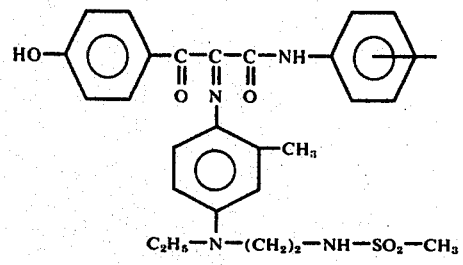
YDG-4 p-Sulfhydrylazophenylphenylene
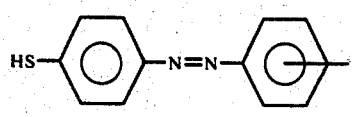
YDG-5
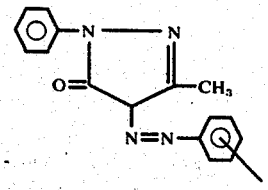
YDG-6
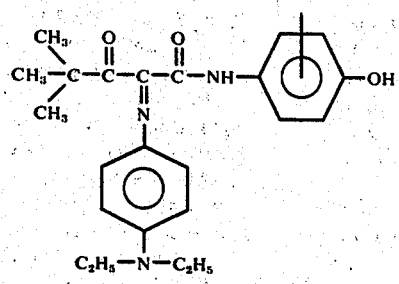
YDG-7
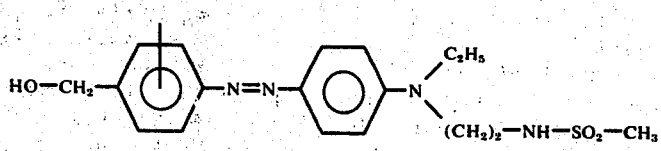
MAGENTA DYE GROUPS
MDG-1
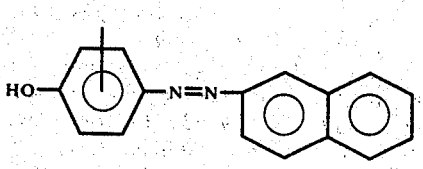
MDG-2
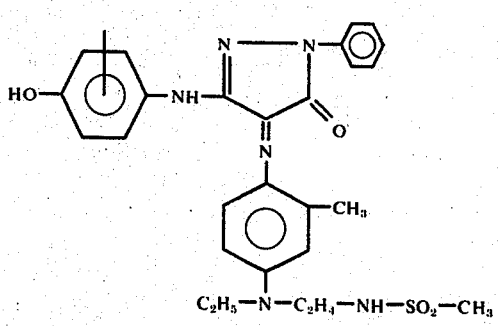
CYAN DYE GROUPS -continued

CDG-1

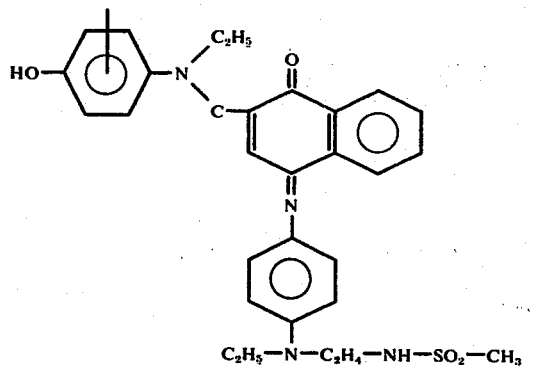

CDG-2

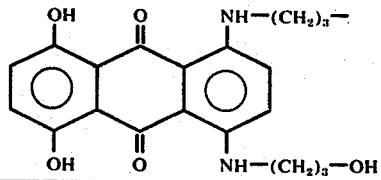

When dye precursor moieties are employed in our invention instead of dyes, they are converted to dyes by means well-known to those skilled in the art, e.g., oxidation, either in the photosensitive element, in the processing composition or in the dye image-receiving layer to form a visible dye. Such techniques are disclosed, for example in British Pat. Nos. 1,157,501; 1,157,502; 1,157,503; 1,157,504; 1,157,505; 1,157,506; 1,157,507; 1,157,508; 1,157,509; 1,157,510; and U.S. Pat. Nos. 2,774,668; 2,698,798; 2,698,244; 2,661,293; 2,559,643; etc.

The alkaline developing compositions employed in this invention are aqueous solutions of an alkaline material, e.g., sodium hydroxide, sodium carbonate or an amine such as diethylamine and contain a black-and-white developing agent as described hereinafter. The first developer composition is formulated so that only a negative silver image is developed and can therefore be referred to as non-cross-oxidizing, since the composition will not oxidize the redox compound. After a fogging step a developer composition is used that will develop the fogged silver and concurrently release a diffusible dye or dye precursor by cross-oxidation.

The developer compositions especially useful in the first step of this invention are alkaline solutions comprising a black-and-white developing agent. During this step, the exposed silver halide is reduced to elemental silver by the developer composition. The developer composition is formulated so that the developing agent will not oxidize the redox compound and release the dye providing moiety. This can be accomplished by proper choice of the black-and-white developing agent or by control of the developer composition pH. Black-and-white developing agents all reduce exposed silver halide to silver, and therefore all are useful in the first step of our process.

The first step of our process can be practiced by employing any conventional black-and-white developing agent in the developer composition known in the art to be a cross-oxidizing agent. In this instance it is merely necessary to maintain the developer composition at a sufficiently low pH to avoid cross-oxidation. All cross-oxidizing silver halide developing agents cease to be cross-oxidizing at lower pH values, although the particular pH value at which a specific developing agent ceases to cross-oxidize varies from one developing agent to another. The proper pH for a developer composition employed in the first step of this invention can be readily determined merely by developing a sample of an exposed photographic element containing a silver halide emulsion layer and associated therewith a sulfonamido or hydroquinone type dye-releasing redox agent as described above capable of releasing a dye upon cross-oxidation. If a dye is observed in the developer composition or is transferred from the photographic sample being processed to a receiving layer, another quantity of developer composition can be made up differing by having a somewhat lower pH and a second sample can be processed therein. If a dye is again observed or transferred, the above procedure can be repeated until a pH is reached at which development of the sample containing the exposed silver halide ceases to produce an observable dye coloration in the developer composition or ceases to be transferred to a receiving layer. While non-cross-oxidizing developer compositions will differ in pH, depending upon the specific developing agent being employed, the first developer composition (or non-cross-oxidizing developer composition) typically exhibits a pH of less than 10.

Upon the completion of development of imagewise exposed silver halide in the first developer composition, the photographic element to be processed according to this invention is next processed to render the residual silver halide developable. This can be accomplished by fogging the remaining silver halide using any convenient conventional technique, such as uniform light exposure, chemical fogging, etc.

The second developing step is next undertaken. This involves bringing the photographic element so far processed into contact with a second developer composition. This developer composition is chosen so that it simultaneously develops the fogged silver halide and concurrently releases a diffusible dye or dye precursor in the non-imagewise exposed areas.

The second developing step can be accomplished using any conventional cross-oxidizing black-and-white silver halide developer compositions known in the art. Such cross-oxidizing silver halide developer compositions and conditions for their use are disclosed, for example, in Gompf et al U.S. Pat. No. 3,698,987 issued Oct. 17, 1972; Anderson et al U.S. Pat. No. 3,725,062 issued Apr. 3, 1973; Becker et al U.S. Pat. No. 3,728,113, issued Apr. 17, 1973; and Figueras et al U.S. Pat. No. 3,734,726, issued May 22, 1973. It is preferred to form the second developer composition through the use of developing agents which are capable of undergoing cross-oxidation at relatively low pH values. It is recognized that the first and second developer compositions can differ significantly only in their pH values—the same developing agent be used in both, but with the pH determining whether the specific developing agent is capable or incapable of entering into a cross-oxidizing reaction. Although considerable variation occurs from one developing agent to another, the second developer composition typically exhibits a pH in excess of 10. Illustrative examples of developing agents which are preferred for use in the second or cross-oxidizing development step of this invention are 1-phenyl-3-pyrazolidone (Phenidone), 1-phenyl-4,4-dimethyl-3-pyrazolidone (Dimezone) and 4-hydroxymethyl-4-methyl-1-phenyl-3-pyrazolidone.

The second or cross-oxidizing developer composition, functions through the developing agent becoming oxidized during development by reducing the fogged silver halide to silver metal and concurrently cross-oxidizing a compound capable of entering into a redox reaction therewith to form a diffusible dye or dye precursor. The dye or precursor is then transferred by diffusion to a dye receiving layer. The dye is transferred in inverse proportion to the initial, imagewise exposure so that a positive dye image is produced.

A black-and-white developing agent when functioning as a cross-oxidizing developing agent (COD) enables a color imaging precursor, such as the redox compound herein, to become oxidized without the color imaging precursor itself developing silver. It can be viewed as an electron transfer agent which shuttles electrons between the developing silver halide and the color imaging precursor. The general definition can be written schematically as follows:

1)* $COD_{Red} + Ag^+ \rightleftharpoons COD_{Ox} + Ag^\circ$

2) $COD_{Ox}$ + Color Imaging $\rightleftharpoons$ $COD_{Red}$ + Color Imaging
Precursor$_{Red}$ Precursor$_{Ox}$

*Subscript "Red" denotes reduced form and "Ox" denotes oxidized form.

The color imaging precursor is any chemical compound which, when oxidized, becomes a material which differs from the precursor in some way (absorption, chemistry, etc.) that can be exploited for imaging.

The color imaging precursor is frequently immobilized in an oil phase, and so a more specific scheme for the formation of a cross-oxidizing developing agent is as follows:

3) $COD_{Red}(H_2O) + Ag^+ \rightleftharpoons COD_{Ox}(H_2O) + Ag^\circ$

4) $COD_{Ox}(H_2O) \rightleftharpoons COD_{Ox}$ (Oil)

5) $COD_{Ox}$ (Oil) + Color Imaging $\rightleftharpoons$
Precursor$_{Red}$ (Oil)
$COD_{Red}$ (Oil) + Color Imaging
Precursor$_{Ox}$ (Oil)

6) $COD_{Red}$ (Oil) $\rightleftharpoons$ $COD_{Red}(H_2O)$

Therefore, the characteristics of a cross-oxidizing developing agent in the most general cases (eq. 1 and 2) are:

a. It has sufficient electrochemical potential under the experimental conditions to develop exposed silver halide.
b. In its oxidized form it is of such electrochemical potential as to oxidize the color imaging precursor.
c. In its oxidized form it is stable to decomposition by other chemical reactions long enough to undergo the redox reaction with the color imaging precursor.

A further characteristic of the preferred system represented by equations 3–6 is:

d. The cross-oxidizing developing agent is chosen so that in its oxidized form it has high solubility in any oil phase, such as coupler solvent, in the photographic element.

Any material can be employed as the image-receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basic polymeric mordants such as polymers of amino guanidine derivatives of vinyl methyl ketone such as described in Minsk U.S. Pat. No. 2,882,156 issued Apr. 14, 1959, and basic polymeric mordants such as described in U.S. Application Ser. No. 100,491 of Cohen et al, filed Dec. 21, 1970, now U.S. Pat. No. 3,709,690, issued June 9, 1973. Other mordants useful in our invention include poly-4-vinyl pyridine, poly-2-vinyl pyridine methyl-p-toluene sulfonate and similar compounds described in Sprague et al U.S. Pat. No. 2,484,430 issued Oct. 11, 1949, etc. Effective mordanting compositions are also described in Whitmore U.S. Pat. No. 3,271,148 and Bush U.S. Pat. No. 3,271,147, both issued Sept. 6, 1966.

Furthermore, the image-receiving layer can be sufficient by itself to mordant the dye as in the case of use of an alkaline solution-permeable polymeric layer such as N-methoxymethyl polyhexylmethylene adipamide; partially hydrolyzed polyvinyl acetate; polyvinyl alcohol with or without plasticizers; cellulose acetate; gelatin; and other materials of a similar nature. Generally, good results are obtained when the image-receiving layer, preferably alkaline solution-permeable, is transparent and about 0.25 to about 0.40 mil in thickness. This thickness, of course, can be modified depending upon the result desired. The image-receiving layer can also contain ultra-violet absorbing materials to protect the mordanted dye images from fading due to ultraviolet light, brightening agents such as the stilbenes, coumarins, triazines, oxazoles, dye stabilizers such as the chromanols, alkylphenols, etc.

Use of a pH-lowering material in the dye image-receiving element of a film unit according to the invention will usually increase the stability of the transferred image. Generally, the pH-lowering material will effect a reduction in the pH of the image layer from about 13 or 14 to at least 11 and preferably 5–8 within a short time after imbibition. For example polymeric acids as disclosed in U.S. Pat. No. 3,362,819 or solid acids or metallic salts, e.g., zinc acetate, zinc sulfate, magnesium acetate, etc., as disclosed in U.S. Pat. No. 2,584,030 may be employed with good results. Such pH-lowering materials reduce the pH of the film unit after development to terminate development and substantially reduce further dye transfer and thus stabilize the dye image.

While the alkaline developing compositions used in this invention can be employed in a rupturable container, as described previously, to facilitate the introduction of processing composition into the film unit conveniently, other methods of inserting developing composition into the film unit can also be employed, e.g., interjecting developing solution with communicating members similar to hypodermic syringes which are attached either to a camera or camera cartridge.

The silver halide emulsions useful in our invention are well-known to those skilled in the art and are described in *Product Licensing Index*, Vol. 92, December, 1971, publication 9232, p. 107, paragraph I, "Emulsion types"; they may be chemically and spectrally sensitized as described on p. 107, paragraph III, "Chemical sensitization", and pp. 108–109, paragraph XV, "Spectral sensitization", of the above article; they can be protected against the production of fog and can be stabilized against loss of sensitivity during keeping by employing the materials described on p. 107, paragraph V, "Antifoggants and stabilizers", of the above article; they can contain development modifiers, hardeners, and coating aids as described on pp. 107–108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on p. 108, paragraph XI, "Plasticizers and lubricants", and paragraph VIII, "Vehicles", and p. 109, paragraph XVI, "Absorbing and filter dyes", of the above article; they and other layers in the photographic elements used in this invention may contain addenda which are incorporated by using the procedures described on p. 109, paragraph XVII, "Methods of addition", of the above article; and they can be coated by using the various techniques described on p. 109, paragraph XVIII, "Coating procedures", of the above article, the disclosures of which are hereby incorporated by reference.

The following example further illustrates the invention:

A single-layer photographic element was prepared to contain:

| | |
|---|---|
| Silver bromide emulsion (0.8$\mu$) | $8 \times 10^{-4}$ mole/ft$^2$ |
| Sulfonamidonaphthol dye-releasing redox agent* | $5 \times 10^{116\ 5}$ mole/ft$^2$ |
| Diethyl lauramide | 71.5 mg/ft$^2$ |
| Gelatin | 300 mg/ft$^2$ |
| Formaldehyde | 2.25 mg/ft$^2$ |

*Sulfonamidonaphthol dye-releasing redox agent was

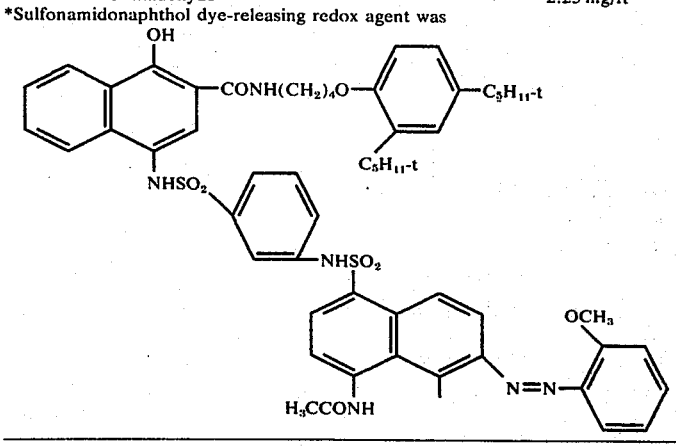

A sample of the above-prepared element was exposed through a graduated-density test object and developed for 2 minutes at 20° C. in Kodak Developer DK-50 (non-cross-oxidizing developer solution) at a pH of 9.5 to produce a negative silver image. Kodak Developer DK-50 has the following composition:

| | |
|---|---|
| Water, about 125° F (52° C) | 500.0 cc |
| N-methyl-p-aminophenol sulfate | 2.5 g |
| Sodium sulfite, desiccated | 30.0 g |
| Hydroquinone | 2.5 g |
| Sodium metaborate | 10.0 g |
| Potassium bromide | 0.5 g |
| Water to make | 1.0 liter |

The development was stopped by immersion of the element in diluted acetic acid. The sample was then washed and dried in room-light to remove the processing solutions and fog the residual silver halide.

The element, now containing a negative silver image, a positive latent image in silver halide and the full complement (as coated) of the sulfonamidonaphthol dye-releasing redox agent was viscous processed while in contact with a dye image receiving element comprising 200 mg/ft² dye mordant** and 200 mg/ft² gelatin. The viscous processing composition contains 0.75 grams 4-hydroxymethyl-4-methyl-1-phenyl-3-pyrazolidone (cross-oxidizing developing agent), 20 grams sodium hydroxide, 10 grams potassium bromide and 20 grams hydroxyethyl cellulose per liter of water (pH=13.7). After 1 minute, the photographic element was separated from the receiver and a positive magenta image was obtained on the receiving element.

** Dye mordant was copoly[styrene/N-benzyl-N,N-dimethyl-N-(3-maleimidopropyl)ammonium chloride]

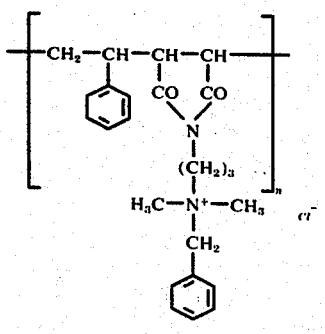

The invention has been described with particular reference to certain preferred embodiments thereof, but it will be understood that variations and modifications can be effected within the spirit and scope of the invention.

We claim:

1. A process for producing a positive photographic transfer color-image which comprises:

1. providing an imagewise exposed photographic element comprised of a support having coated thereon an imagewise exposed, light-sensitive negative-working silver halide emulsion layer and associated therewith a sulfonamido-type dye-releasing redox agent of the formula:

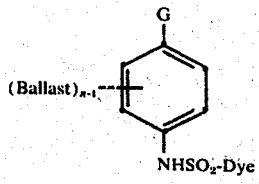

wherein:

a. Dye is a dye or dye precursor moiety which is diffusible when released from the dye releasing redox agent;

b. Ballast is an organic ballasting radical of such molecular size and configuration as to render the sulfonamido-type dye-releasing redox agent non-diffusible during development in an alkaline processing composition;

c. G is OR or $NHR_1$ wherein R is hydrogen or a hydrolyzable moiety and $R_1$ is hydrogen or an alkyl group of 1 to 22 carbon atoms; and d. *n* is a positive integer of 1 or 2 and is 2 when G is OR or when $R_1$ is hydrogen or an alkyl group of less than 8 carbon atoms;

2. developing imagewise exposed silver halide in the silver halide emulsion layer to produce a silver image without concurrent release of the Dye moiety of the redox dye-releasing agent;

3. fogging residual silver halide in the silver halide emulsion layer;

4. developing the fogged residual silver halide in the silver halide emulsion layer and currently releasing the Dye moiety of the dye-releasing redox agent in the areas of the silver halide emulsion layer corresponding to those containing the fogged residual silver halide; and 5. permitting at least a portion of the released Dye moiety to diffuse to a dye image receiving means.

2. A process according to claim 1 wherein the first development step is performed using a silver halide developer having a pH of less than 10 and the second development step is performed using a silver halide developer having a pH in excess of 10.

3. A process for producing a multicolor positive photographic transfer image which comprises:

1. providing an imagewise exposed photographic element comprising a support having coated thereon a red-sensitized color-forming unit, a green-sensitized color-forming unit and a blue sensitive color-forming unit, each of the color-forming units being comprised of an imagewise exposed, light-sensitive negative-working silver halide emulsion layer and associated therewith a sulfonamido-type dye-releasing redox agent of the formula:

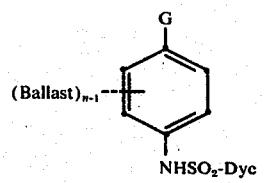

wherein:

a. Dye is dye or dye precursor moiety which is diffusible when released from the dye-releasing redox agent;

b. Ballast is an organic ballasting radical of such molecular size and configuration as to render the sulfonamido-type dye-releasing redox agent non-diffusible during development in an alkaline processing composition;

c. G is OR or $NHR_1$ wherein R is hydrogen or a hydrolyzable moiety and $R_1$ is hydrogen or an alkyl group of 1 to 22 carbon atoms; and d. *n* is a positive integer of 1 or 2 and is 2 when G is OR or when $R_1$ is hydrogen or an alkyl group of less than 8 carbon atoms;

with the further proviso that in the red-sensitized color-forming unit the Dye moiety is chosen to yield a cyan image dye, in the green-sensitized color-forming unit the Dye moiety is chosen to yield a magenta dye and in the blue sensitive color-forming unit the Dye moiety is chosen to yield a yellow image dye;

2. developing imagewise exposed silver halide in the silver halide emulsion layers to produce a silver image without concurrent release of the Dye moiety of the associated redox dye-releasing agent;

3. fogging residual silver halide in the silver halide emulsion layers;

4. developing the fogged residual silver halide in the silver halide emulsion layers and currently releasing the Dye moiety of the dye-releasing redox agents in the areas of the silver halide emulsion layers corresponding to those containing the fogged residual silver halide; and 5. permitting at least a portion of the released Dye moieties to diffuse to a dye image receiving means.

4. A process according to claim 3 wherein the first development step is performed using a silver halide developer having a pH of less than 10 and the second development step is performed using a silver halide developer having a pH in excess of 10.

5. A process for producing a positive photographic transfer color-image which comprises:

1. providing an imagewise exposed photographic element comprised of a support having coated thereon an imagewise exposed, light-sensitive negative-working silver halide emulsion layer and associated therewith a hydroquinone type dye-releasing redox agent of the formula:

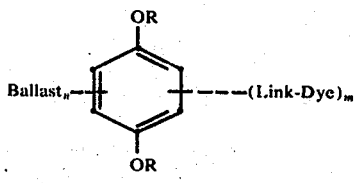

wherein:

a. each R represents hydrogen or a hydrolyzable moiety;

b. Ballast is a photographically inert organic ballasting radical of such molecular size and configuration as to render the dye-releasing redox agent nondiffusible during development in an alkaline processing composition;

c. Dye is a diffusible dye or dye precursor moiety which is diffusible when released from the dye-releasing redox agents;

d. Link is an S, O or $SO_2$ linking group;

e. *n* is an integer of 1 to 3; and f. *m* is an integer of 1 to 3;

2. developing imagewise exposed silver halide in the silver halide emulsion layer to produce a silver image without concurrent release of the Dye moiety of the redox dye-releasing agent;

3. fogging residual silver halide in the silver halide emulsion layer;

4. developing the fogged residual silver halide in the silver halide emulsion layer and currently releasing the Dye moiety of the dye-releasing redox agent in the areas of the silver halide emulsion layer corresponding to those containing the fogged residual silver halide; and 5. permitting at least a portion of the released Dye moiety to diffuse to a dye image receiving means.

6. A process according to claim 5 wherein the first development step is performed using a silver halide developer having a pH of less than 10 and the second development step is performed using a silver halide developer having a pH in excess of 10.

7. A process for producing a multicolor positive photographic transfer image which comprises:

1. providing an imagewise exposed photographic element comprising a support having coated thereon a red-sensitized color-forming unit, a green-sensitized color-forming unit and a blue sensitive color-forming unit, each of the color-forming units being comprised of an imagewise exposed, light-sensitive negative-working silver halide emulsion layer and associated therewith a hydroquinone-type dye-releasing redox agent of the formula:

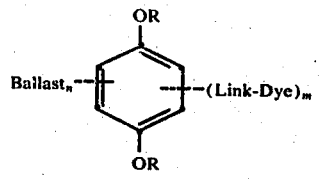

wherein:

a. each R represents hydrogen or a hydrolyzable moiety;

b. Ballast is a photographically inert organic ballasting radical of such molecular size and configuration as to render the dye-releasing redox agent nondiffusible during development in an alkaline processing composition;

c. Dye is a dye or dye precursor moiety which is diffusible when released from the dye-releasing redox agent;

d. Link is an S, O or $SO_2$ group;

e. *n* is an integer of 1 to 3; and f. *m* is an integer of 1 to 3;

with the further proviso that in the red-sensitized color-forming unit the Dye moiety is chosen to yield a cyan image dye, in the green-sensitized color-forming unit the Dye moiety is chosen to yield a magenta dye and in the blue sensitive color-forming unit the Dye moiety is chosen to yield a yellow image dye;

2. developing imagewise exposed silver halide in the silver halide emulsion layers to produce a silver image without concurrent release of the Dye moiety of the associated redox dye-releasing agent;

3. fogging residual silver halide in the silver halide emulsion layers;

4. developing the fogged residual silver halide in the silver halide emulsion layer and currently releasing the Dye moiety of the dye-releasing redox agents in the areas of the silver halide emulsion layers corresponding to those containing the fogged residual silver halide; and 5. permitting at least a portion of the released Dye moieties to diffuse to a dye image receiving means.

8. A process according to claim 7 wherein the first development step is performed using a silver halide developer having a pH of less than 10 and the second development step is performed using a silver halide developer having a pH in excess of 10.

* * * * *